US005582049A

United States Patent [19]

Mauer

[11] Patent Number: 5,582,049

[45] Date of Patent: Dec. 10, 1996

[54] COMBINATION LOCK WITH FOUR DIAL BUTTONS

[75] Inventor: Gunter Mauer, Heiligenhaus, Germany

[73] Assignee: Mauer GmbH, Heiligenhaus, Germany

[21] Appl. No.: 356,836

[22] Filed: Dec. 14, 1994

[30] Foreign Application Priority Data

Dec. 17, 1993 [DE] Germany ..... 43 43 161.5

[51] Int. Cl.[6] ..... E05B 37/00

[52] U.S. Cl. ..... 70/312; 70/315; 70/304

[58] Field of Search ..... 70/301, 303 A, 70/304, 312, 313, 321, 323, 315, 316, 213

[56] References Cited

U.S. PATENT DOCUMENTS

| | | | |
|---|---|---|---|
| 3,863,469 | 2/1975 | Atkinson | 70/312 |
| 4,669,286 | 6/1987 | Cheng | 70/312 |
| 4,782,673 | 11/1988 | Castelli et al. | 70/312 |
| 5,485,734 | 1/1996 | Yang | 70/312 |

*Primary Examiner*—Steven N. Meyers
*Assistant Examiner*—Tuyet-Phuong Pham
*Attorney, Agent, or Firm*—Edwin D. Schindler

[57] ABSTRACT

A combination lock is disclosed having four dial buttons arranged in a lock box in a rectangular fashion with a handle driving a bolt which is controlled by the dial buttons. The bottom of the lock box has four bearing sleeves supporting four base plates provided with "n" number of teeth. Each base plate has, on its jacket surface, a radial groove. A cross-shaped scan lock is swivel-mounted between the base plates, with the scan lock having four scan pins, or burls, fitting into the radial grooves of each of the base plates, and a lock block immersing in the bolt. Catch disks are provided with "n" number of teeth and square-shaped holes, which are supported on the base plates. The dial buttons are provided with square shafts and have "n" numbers or symbols immersed in the catch disks. Each base plate also has a concentric bore and each bore has a coupling pin provided with conical ends. The pins engage conical bores of a switch plate and one of "n" bores of the catch disks. The swivel-mounted switch plate is actuated by a control nut of the bolt. When the bolt is extended, the switch plate pushes the coupling pins upward and couples the base plates with the catch disks so that, upon closing of the lock, the combination can be cancelled by simply turning the dial buttons.

5 Claims, 4 Drawing Sheets

COMBINATION LOCK WITH FOUR DIAL BUTTONS

BACKGROUND OF THE INVENTION

1. Technical Field of the Invention

The present invention relates to a combination lock with four dial buttons. More particularly, the present invention relates to a combination lock with four dial buttons, which are arranged in a lock box in a rectangular formation, with a handle driving a bolt controlled by the dial buttons.

2. Description of the Prior Art

Combination locks having four dial buttons are generally known in the art as light-duty suitcase or locker locks.

European Patent Application No. 0,139,026 discloses a combination lock having three coding buttons, which are disposed in the axis of the lock one after another. The locking disks used have diametral locking slides, which are guided in a reversing slide. Such a lock has been developed with three buttons, each having 26 dial positions so that $26^3$ combinations, i.e., 42,875 combinations, are possible. The design of such a lock results in a very small angular steps, consequently, a high level of manufacturing precision is required.

The present invention is intended to overcome the inherent difficulties encountered in the manufacturing process of such locks, as discussed by the cited prior art, as well as providing numerous other benefits, to be discussed hereinafter.

SUMMARY OF THE INVENTION

It is, therefore, an object of the present invention to provide a combination lock which has a comparatively large number of possible combinations, yet which can be manufactured at a favorable cost.

It is an additional object of the present invention to provide a combination lock having a high degree of safety from improper manipulation or tampering.

It is, yet, a further object of the present invention to provide a combination lock which overcomes the disadvantages inherent in such prior art locks, as discussed herein and as generally known to the skilled artisan.

The foregoing and related objects are achieved by the combination lock of the present invention, which includes four dial buttons arranged in a lock box in a rectangular fashion with a handle driving a bolt which is controlled by the dial buttons. The bottom of the lock box has four bearing sleeves supporting four base plates provided with "n" number of teeth. Each base plate has, on its jacket surface, a radial groove. A cross-shaped scan lock is swivel-mounted between the base plates, with the scan lock having four scan pins fitting into the radial grooves of each of the base plates, and a lock block immersing in the bolt.

Catch disks are provided with "n" number of teeth and square-shaped holes, which are supported on the base plates. The dial buttons are provided with square shafts and have "n" numbers or symbols immersed in the catch disks.

Each base plate also has a concentric bore and each bore has a coupling pin provided with conical ends. The pins engage conical bores of a switch plate and one of "n" bores of the catch disks. The swivel-mounted switch plate is actuated by a control nut of the bolt. When the bolt is extended, the switch plate pushes the coupling pins upward and couples the base plates with the catch disks so that, upon closing of the lock, the combination can be cancelled by simply turning the dial buttons.

Other objects and features of the present invention will become apparent when considered in combination with the accompanying drawing figures which illustrate certain preferred embodiments of the present invention. It should, however, be noted that the accompanying drawing figures are intended to illustrate only certain embodiments of the claimed invention and are not intended as a means for defining the limits and scope of the invention.

BRIEF DESCRIPTION OF THE DRAWING FIGURES

In the drawing, wherein similar reference numerals denote similar features throughout the several views:

FIGS. 1*a* and 1*b* are each prospective, exploded views of the combination lock of the present invention;

FIG. 2 is a plan view of the underside of the lock bolt of the present invention; and, FIG. 3 is an exploded view of the mounted lock with operating elements.

DETAILED DESCRIPTION OF THE DRAWING FIGURES AND PREFERRED EMBODIMENTS

Figure 1A:
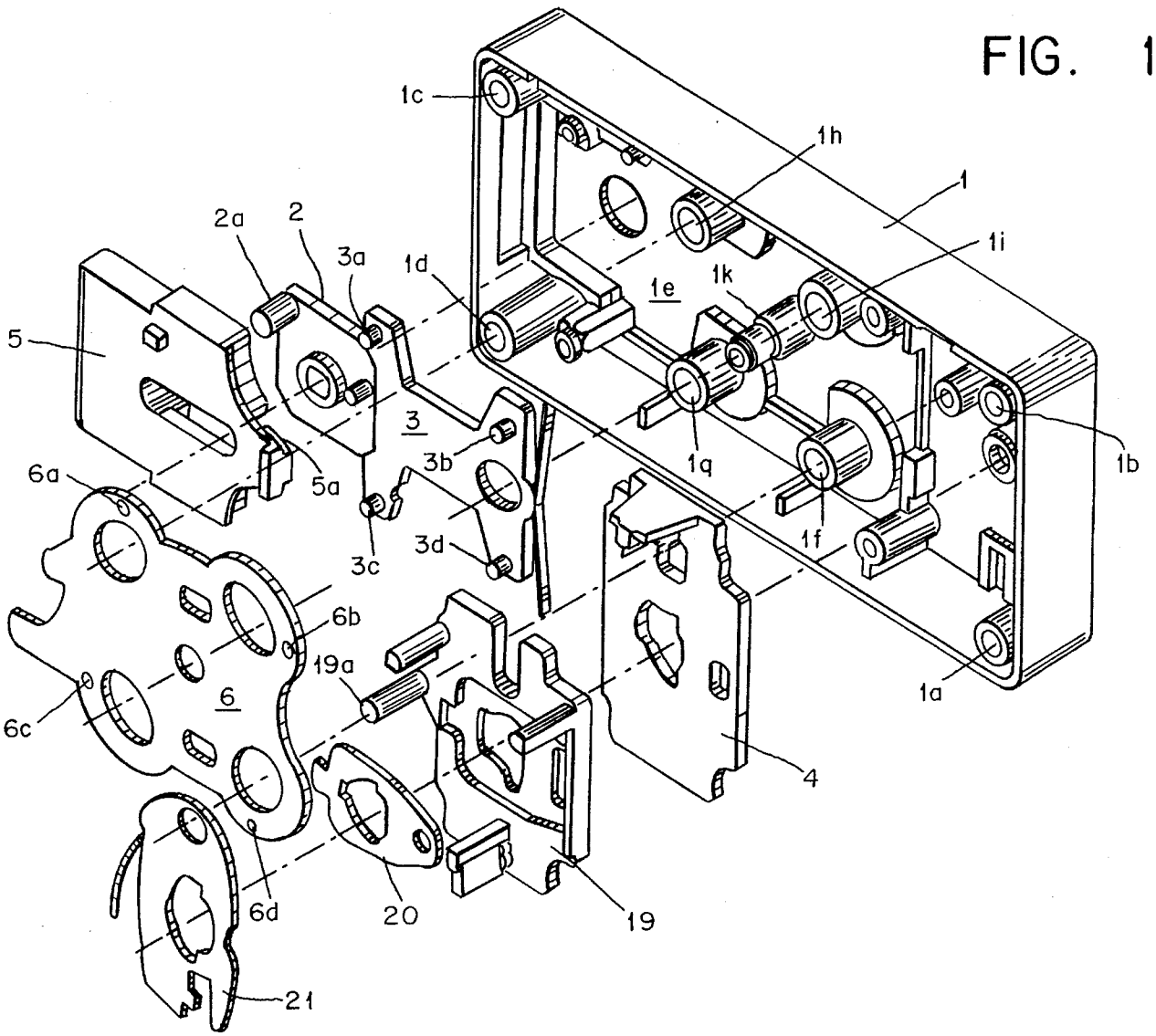
Figure 1B:
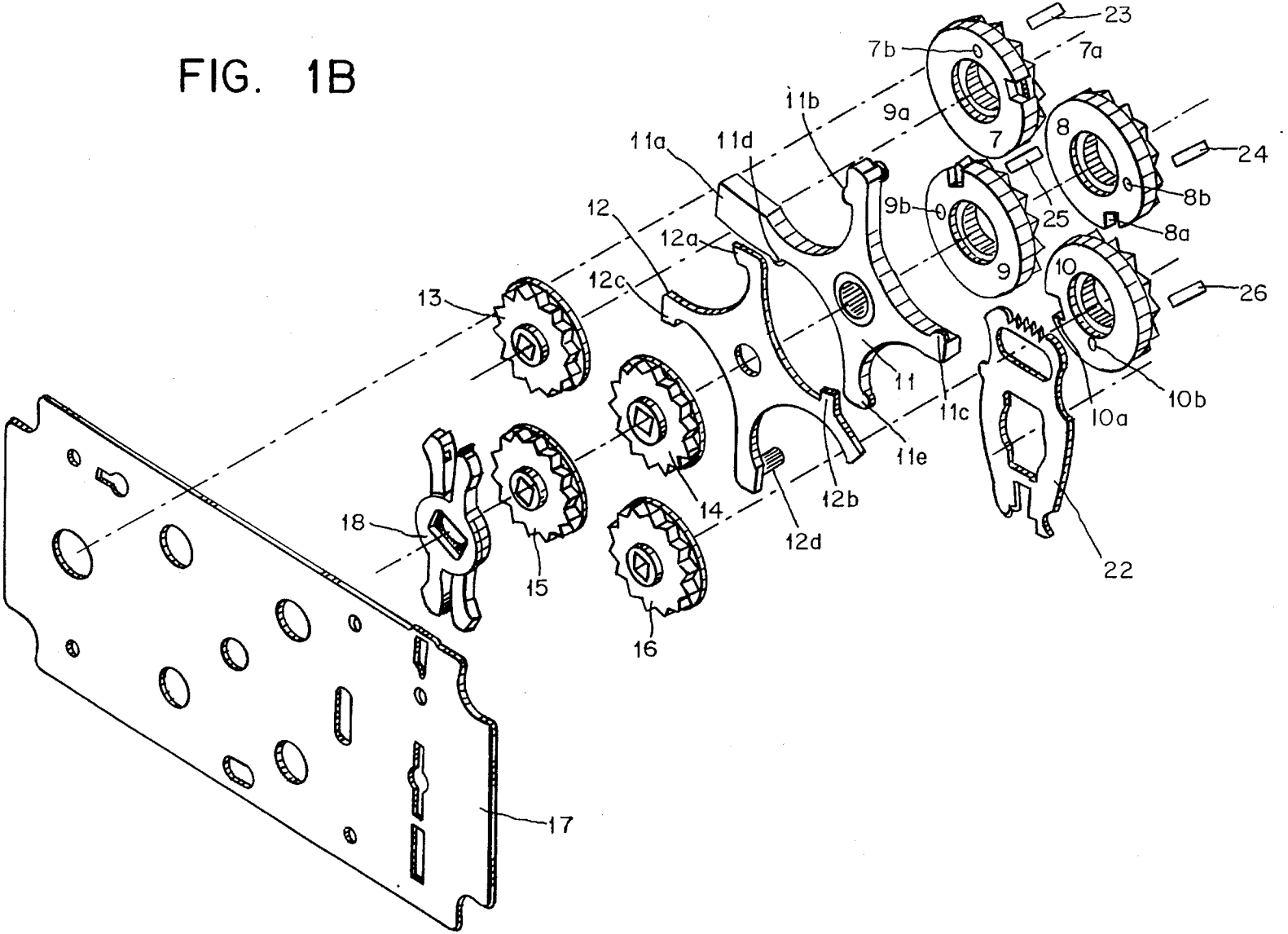

Turning now, in detail, to an analysis of the drawing figures, reference numeral 1 denotes a lock box, which is, preferably, injection-molded from a dimensionally stable thermoplastic. In the four corners of lock box 1 are guide tubes 1*a*, 1*b*, 1*c*, 1*d*, for fastening screws, shaped by molding. The lock box bottom 1*e* supports four bearing sleeves 1*f*, 1*g*, 1*h*, 1*i* for supporting rotatable parts; said bearing sleeves, preferably, being injected in place. An additional bearing pin 1*k* is arranged between the bearing sleeve.

A major portion of the lock housing is occupied by the combination mechanics. As illustrated in a preferred embodiment, in a right-hand portion of the lock housing, a double-bit switch lock, with an emergency bolt, is present. This bolt permits opening if the combination is forgotten.

A control nut 2 with a square recess, a set slide 3 and a switch bolt 4 are disposed directly on the bottom of the lock box. The lock bolt 5 is supported via the control nut 2. A switch plate 6 is swivel-mounted on the pin 1*k*. The switch plate has a number of oval breakthroughs gripping around the bearing sleeves 1*f*, 1*g*, 1*h*, 1*i*, among others. Four base plates 7, 8, 9, 10 are pushed onto said sleeves. A cross-shaped scan lock 11 and a scan lever 12 are disposed between the base plates.

Four catch disks 13, 14, 15, 16, having an inside square opening, are guided in base plates 7, 8, 9, 10, on the one hand, and supported in lock cover 17, on the other hand. An elastic dial pawl 18 assures that the catch disks are always adjusted by full steps.

Figure 3:
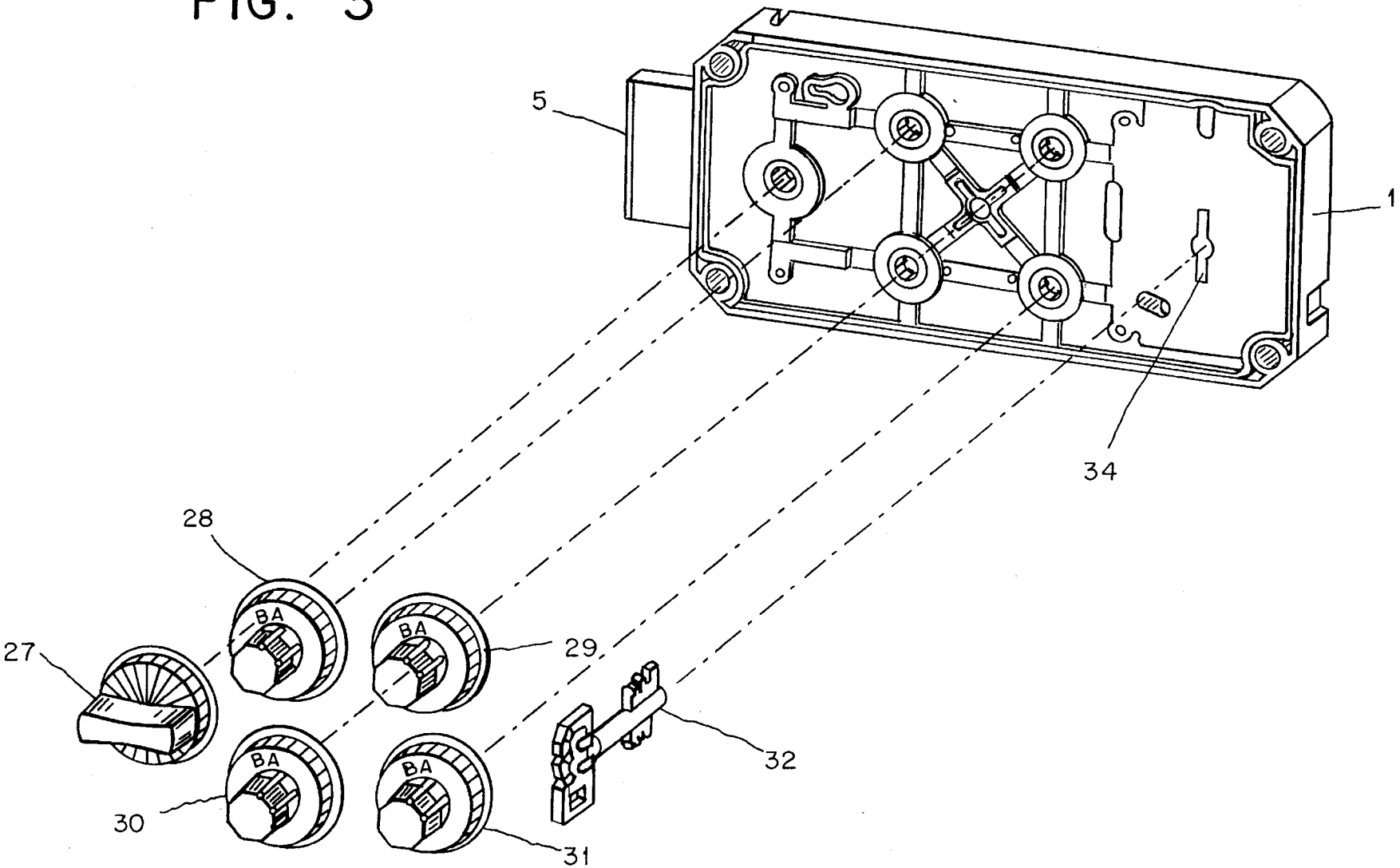

The associated dial buttons, with square shafts and alphabetical and/or numerical symbols are shown in FIG. 3.

The double-bit switch lock comprises, in addition to the switch bolt 4, an emergency bolt 19, a swivel 20, a tumbler 0 (with number 21), and a set of tumblers 1, of which, however, only one (22) is shown. The double-bit lock conforms to the state of the art and functions in a manner known to the artisan having ordinary skill in the art. As it concerns the present invention, a pin 19*a* of the emergency bolt 19 releases the scan lever 12, which permits scanning of the "forgotten" combination.

FIG. 3 shows the finished lock with the operating elements. The lock box 1 is shown, from which the lock bolt 5 projects. The bolt is actuated by a handle 27. Numerals 28, 29, 30, 31 denote dial buttons, which act on the installed arresting disks via square shafts. In the selected example with n=14 arrest positions, each button carries the letters A, B, C, D and the numerals 0 to 9. With four dial buttons, $14^4$=38,416 combination are obtained.

If the user has forgotten the selected combination, an emergency opening can be carried out with the double-bit key 32. The associated keyhole is denoted by reference numeral 34.

The part functions of the combination lock of the present invention can be classified as follows:

A. The tumbler system

B. The switch system

C. The protection against manipulation

D. The emergency opening system

A. The Tumbler System

Figure 2:
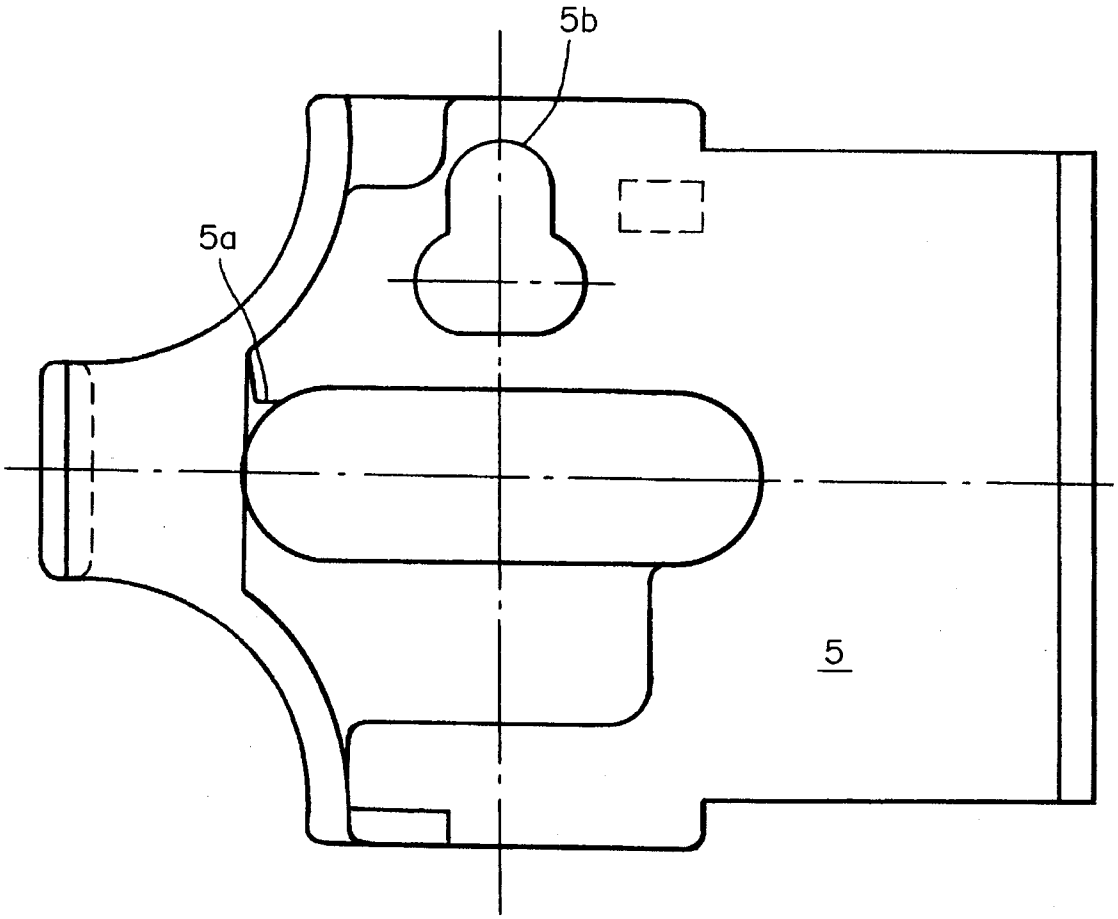

As illustrated in FIG. 2, on its underside, the bolt 5 has a turn pin duct 5*a*. The bolt 5 can be retracted with the aid of the control nut 2, only if the block 11*a* of scan lock 11 can exactly immerse in the duct 5*a*. This position is reached when the hurls 11*b*, 11*c*, 11*d*, 11*e* can immerse in the radial grooves 7*a*, 8*a*, 9*a*, 10*a* of the base plates.

The catch disks 13, 14, 15, 16 have, on their backsides, "n" cone-like deepenings conforming to the number of the teeth. The base plates 7, 8, 9, 10 are provided with concentric bores 7*b*, 8*b*, 9*b*, 10*b*, respectively, in which the cylinder coupling pins, 23, 24, 25, 26 are displacingly supported; said cylinder pins being pointed on both sides. The length of said pins is dimensioned so that the pins immerse in the deepenings of the catch disks when the right ends rest on the plane surface of the switch plate. Accordingly, each of the base plates 7, 8, 9, 10 is, in any one of "n" positions, coupled with the catch disks 13, 14, 15, 16 and, thus, with the dial buttons.

When the selected combination is dialed, the grooves 7*a*, 8*a*, 9*a*, 10*a* are disposed in front of the burls of the scan lock 11. When the handle of the lock is then actuated, the scan lock drops into the grooves of the base plates and the locking block 11*a* can immerse in the turn pin duct 5*a* of the bolt. The bolt can now be fully retracted.

When the door is closed and the lock bolt 5 drives into the frame of the door, the combination can subsequently be cancelled by turning the dial buttons. This means that each base plate 7, 8, 9, 10 can assume any one of "n" positions and that the bolt, therefore, is locked.

B. The Switch System

When the lock bolt 5 is retracted, the control nut 2, via a control pin, moves the switch plate 6 into a switching position. In said position, each of the coupling pins 23, 24, 25, 26 is faced by a conical bore 6*a*, 6*b*, 6*c*, 6*d*, so that the pins exit from the catch disks 13, 14, 15, 16 when the dial buttons are actuated. Such decoupling means that each turning of the dial buttons effects, when the locker is open, a new setting of the combination. When the locker is then closed, the switch plate 6 returns to the normal position and the pins 23, 24, 25, 26 are pushed back into the coupling position.

When the locker is closed, each turning of the dials means a cancellation of the combination, or its setting for opening the locker.

C. Protection Against Manipulation

With combination locks, the basic risk is that unauthorized persons will attempt to scan the combination by actuating, e.g., via touch or using stethoscopes, the handle and the buttons in order to find catch points.

In order to minimize, if not outright prevent, the foregoing type of manipulation, the set slide 3 is moved with the aid of the control nut 2 in such a way that the locking pins 3*a*, 3*b*, 3*c*, 3*d* immediately drop into the toothing of the base plates 7, 8, 9, 10, retaining the latter. Consequently, the dial buttons can be adjusted only when the handle is not stressed.

D. The Emergency Opening System

When combination locks are to be used in places other than banks, i.e., in hotels, public baths, schools or luggage storage facilities, many people not familiar with such locks come into contact with them. Therefore, it will frequently occur that a secret combination will be forgotten. For such instances, provision is made in the present invention for a double-bit lock with an emergency bolt 19, whose pin 19*a* releases the scan lever 12. Said lever, which is under spring force, has the noses 12*a*, 12*b*, 12*c*, 12*d*, which slide on the cylinder jacket of the base plates 7, 8, 9, 10. When the buttons are adjusted one after the other, one nose after the other drops into grooves 7*a*, 8*a*, 9*a*, 10*a*. When the handle is subsequently actuated, the scan lock 11 snaps in as well as releases the lock bolt 5.

Finally, the emergency bolt 19 is retracted and the key is pulled outward. This drives the scan lever, again, into the locking position, in which dropping into the base plates is prevented.

The manufacturing cost of the combination lock of the present invention, described herein, can be decisively reduced by injection-molding as many component parts as possible from a dimensionally stable thermoplastic with impact strength. This would apply to the lock box 1; the bolt 5; the base plate 7, 8, 9, 10; the scan lock 11; the catch disks 13, 14, 15, 16; and, the dial pawl 18.

While only several embodiments of the present invention have been shown and described, it will be obvious to those skilled in the art that many modifications may be made to the present invention without departing from the spirit and scope thereof.

LIST OF REFERENCE NUMERALS

| | |
|---|---|
| 1 | lock box |
| 1a, 1b, 1c, 1d | guide tubes |
| 1e | lock box bottom |
| 1f, 1g, 1h, 1i | bearing sleeves |
| 1k | bearing pin |
| 2 | control nut |
| 3 | set slide |
| 3a, 3b, 3c, 3d | locking pins |
| 4 | switch bolt |
| 5 | lock bolt |
| 5a | turn pin duct |
| 6 | switch plate |
| 6a, 6b, 6c, 6d | conical bores |
| 7, 8, 9, 10 | base plates |
| 7a, 8a, 9a, 10a | radial grooves |
| 7b, 8b, 9b, 10b | concentric bores |
| 11 | scan lock |
| 11a | locking block |
| 11b, 11c, 11d, 11e | burls |
| 12 | scan lever |
| 12a, 12b, 12c, 12d | noses |
| 13, 14, 15, 16 | catch disks |
| 17 | lock cover |
| 18 | dial pawl |
| 19 | emergency bolt |
| 19a | pin |
| 20 | swivel |
| 21 | Tumbler 0 |
| 22 | Tumblers 1 |
| 23, 24, 25, 26 | coupling pins |

What is claimed is:

1. A combination lock, comprising:

a lock box having a handle driving a lock bolt;

coupling pins provided with conical ends;

a control nut;

a switch plate having conical bores, said switch plate being actuated by said control nut of said lock bolt;

four base plates provided with "n" number of teeth, each of said four base plates having a jacket surface with a radial groove therein, each of said four base plates having a concentric bore with each of said concentric bores having said coupling pins;

a cross-shaped scan lock being swivel-mounted between said base plates, said cross-shaped scan lock having four burls capable of fitting into said radial grooves of said base plates;

four dial buttons arranged in said lock box, said lock box having four bearing sleeves supporting said four base plates, said lock bolt being controlled by said dial buttons;

locking block immersing in said lock bolt; and, catch disks provided with "n" number of teeth and having holes supported on said base plates, said dial buttons being provided with shafts shaped for communicating with said holes of said catch disks, said dial buttons having "n" symbols immersed in said catch disks, said coupling pins engaging the conical bores of said switch plate and one of the holes of said catch disks, whereby, when said lock bolt is in an extended position, said switch plate pushes said coupling pins upward for coupling said base plates with said catch disks so that, upon closing of said combination lock, a combination can be cancelled by turning said dial buttons.

2. The combination lock according to claim 1, wherein said lock box has a rectangular shape.

3. The combination lock according to claim 1, wherein said catch disks are provided with square holes and said dial buttons have square-shaped shafts.

4. The combination lock according to claim 1, further comprising a set slide having a plurality of locking pins, said set slide being driven by said control nut so that said locking pins of said set slide engage the teeth of said base plates and said dial buttons are blocked when said handle is stressed.

5. The combination lock according to claim 1, further comprising a double-bit lock having an emergency bolt with an emergency bolt pin and a spring-loaded scan lever having a plurality of noses, wherein said emergency bolt pin is able to release said spring-loaded scan lever upon turning of said dial buttons thereby allowing said plurality of noses to drop in a sequential fashion into said radial grooves of said base plates for retaining said radial grooves in an opening mode so that, subsequently, when said handle is actuated, said burls are able to drop into said scan lock with said lock bolt driven by said handle of said lock box being retractable.

* * * * *